US005674554A

United States Patent [19]

Liu et al.

[11] Patent Number: 5,674,554

[45] Date of Patent: Oct. 7, 1997

[54] METHOD FOR FORMING A PHOSPHOR LAYER

[75] Inventors: Nan-chou David Liu, Chutung; Jin-Yuh Lu, Taipei, both of Taiwan; Lyuji Ozawa, Hopewell Junction, N.Y.

[73] Assignee: Industrial Technology Research Institute, Hsinchu, Taiwan

[21] Appl. No.: 589,278

[22] Filed: Jan. 22, 1996

[51] Int. Cl.[6] ..... B05D 1/12; B05D 1/36; B05D 5/12

[52] U.S. Cl. ..... 427/71; 427/180; 427/189; 427/203; 427/227

[58] Field of Search ..... 427/64, 68, 71, 427/180, 189, 203, 208.4, 208.8, 227, 348, 352, 421; 445/36; 313/455, 467, 504

[56] References Cited

U.S. PATENT DOCUMENTS

| | | | |
|---|---|---|---|
| 3,753,710 | 8/1973 | Jones et al. | 96/36.1 |
| 4,318,971 | 3/1982 | Nishizawa et al. | 430/28 |
| 4,423,128 | 12/1983 | Koike et al. | 430/28 |
| 4,556,595 | 12/1985 | Ochi | 428/143 |
| 4,716,052 | 12/1987 | Waugh et al. | 427/147 |
| 4,732,828 | 3/1988 | Sagou et al. | 430/28 |
| 5,002,844 | 3/1991 | Cheong et al. | 430/28 |
| 5,011,709 | 4/1991 | Arbogast et al. | 427/56.1 |
| 5,085,958 | 2/1992 | Jeong | 430/25 |
| 5,213,918 | 5/1993 | Donofrio | 430/23 |
| 5,256,463 | 10/1993 | Osaka et al. | 428/77 |
| 5,391,444 | 2/1995 | Cuppen | 430/23 |

FOREIGN PATENT DOCUMENTS 5646642 4/1981 Japan .

OTHER PUBLICATIONS

K. Oki & L. Ozawa, "A Phosphor Screen For High Resolution CRTS", Journal of SID, Sep. 1995, p. 1–7.

*Primary Examiner*—Shrive Beck
*Assistant Examiner*—Fred J. Parker
*Attorney, Agent, or Firm*—George O. Saile; Stephen B. Ackerman

[57] ABSTRACT

A method for forming a layer of particles on a substrate, such as a layer of phosphor particles on the inside of a CRT, is described. The depends on the use of a double-sided adhesive tape comprising a laminate of a dry adhesive between two protective layers. One of the protective layers is stripped away to expose one surface of the dry adhesive layer which is then pressed up against the substrate surface using a method such as rolling or autoclaving to bring about bubble-free adhesion. The other protective layer is then stripped away, thereby exposing the other surface of the adhesive layer. The particles that will comprise the final layer are then applied to the exposed adhesive surface by means of dusting. This is followed by the removal of any weakly adhering particles from the final particle layer. Finally, the dry adhesive layer is itself removed by means of a heat treatment, leaving in place a uniform layer of particles adhering to the substrate surface.

11 Claims, 2 Drawing Sheets

METHOD FOR FORMING A PHOSPHOR LAYER

BACKGROUND OF THE INVENTION

(1) FIELD OF THE INVENTION

The invention relates to the general field of phosphor screens for flat panel displays and cathode ray tubes and to methods for forming them.

(2) DESCRIPTION OF THE PRIOR ART

Phosphorescent screens for cathode ray tubes (CRTs) comprise one or more layers of phosphor particles adhering to an inside surface of the tube. Although a single continuous layer of particles is to be preferred, in practice several layers of particles are necessary if dark spots in the display are to be eliminated. This is achieved by using more than one layer, although this leads to reduced optical resolution. A number of methods for forming such screens are known and used in the prior art. All of these methods make use of so-called wet adhesives. Such wet adhesives are often, but not necessarily, light sensitive at some stage and so may be used as photoresists as well as adhesives.

A summary of the prior art has been provided by K. Oki and L. Ozawa in their article "A phosphor screen for high resolution CRTs" which appeared in Journal of the SID in September 1995. They identify two main methods for preparing phosphor screens:

In the sedimentation method the phosphor particles are suspended in a wet viscous medium which is screen printed onto the inside surface of the CRT. The phosphor particles are then allowed to settle onto said surface, either by gravity alone or with the aid of a centrifuge. Sedimentation times tend to be rather long (15 to 20 hours) and in situ drying of the suspension medium must be guarded against at all times. Although an ideal range for the phosphor particle sizes would be between 1 and 1.5 microns, in terms of ultimate screen resolution, the settling times for such small particles is unacceptably long so that, in practice, the particles tend to average about 2.5 microns in size.

In the dusting method a wet, sticky acrylic resin film is first laid down on the inside surface of the CRT by spin coating following which the phosphor particles are sprayed onto said sticky surface from a nozzle and pressed gently into said surface. To remove those particles of phosphor that are adhering to other phosphor particles, rather than the sticky acrylic resin, a brush is gently applied and they are wiped away. As an alternative, a fluid, such as air or water, could have been used to blow the weakly adhering particles away.

Once the phosphor particles have been brought into contact with the inside surface of the CRT, the material that is holding them in place (the sticky resin) needs to be removed, without disturbing the layer of phosphor particles. The preferred method for accomplishing this has been to chemically decompose the sticky resin into volatile byproducts by heat treating in a suitable atmosphere. Melting of the resin during this process must be carefully avoided as the molten resin tends to agglomerate into distinct droplets which pull phosphor particles with them.

Koike et al. (U.S. Pat. No. 4,423,128 December 1983) describe a slurry method wherein various additives are used to prevent premature gelling of the viscous medium. In their specification, allusion is made to Japanese Patent Publication #46642/1981 which proposes " . . . to apply a material exhibiting moderate adhering and bonding properties to the inner surface of the face plate panel and then apply the phosphor in the dry particle form to the inner surface of the face plate panel to cause the phosphor to adhere thereto."

Jeong (U.S. Pat. No. 5,085,958 February 1992) describes a 'standard' dry dusting method wherein phosphor powder is injected into a layer of photoresist which was originally applied as a liquid layer. The invention is concerned mainly with the method whereby the phosphor powder is applied (namely spraying).

Nishizawa et al. (U.S. Pat. No. 4,318,971 March 1982) teaches a method wherein a mildly tacky layer is applied (by an unspecified method) and then exposed to light. The exposed portions of the layer now become significantly more tacky which allows phosphor particles to be selectively stuck to them.

Cuppen (U.S. Pat. No. 5,391,444 February 1995) gives a more detailed description of Nishizawa et al.'s general method and extends it to several new applications.

Sagou et al. (U.S. Pat. No. 4,732,828 March 1988) forms a sticky photoresist layer by applying a wet slurry. Said photo-resist is formulated so that it can be reactivated (made light sensitive again), by means of a heat treatment, multiple times. This allows the formation of multiple patterns with only one application of photoresist.

The disadvantages of using a wet adhesive for capturing and holding the phosphor particles are well known. They include control of layer thickness from one application to another, the need for maintaining a level surface, premature drying of the adhesive, etc. A simple method for applying a dry adhesive layer is, therefore, desired.

SUMMARY OF THE INVENTION

It is an object of the present invention to provide a method for forming a layer of particles on a substrate, such as a layer of phosphor particles on an inside surface of a flat panel display or cathode ray tube or.

An additional object of the present invention is to provide a method for forming a layer of particles on a substrate, such as a layer of pigment particles for use in a liquid crystal display.

Another object of the present invention is that a dry, rather than a wet, adhesive be used.

Yet another object of the present invention is to facilitate the use of very small particles in the formation of said layer, thereby allowing a screen having high optical resolution and high optical transmittance to be formed.

A further object of the present invention is that said method be cheap, efficient, and easy to use.

A still further object of the present invention is that said method have a shorter turnaround time than that used for wet adhesives.

These objects have been achieved by use of a double-sided adhesive tape comprising a laminate of a dry adhesive between two protective layers. One of the protective layers is stripped away to expose one surface of the dry adhesive layer which is then pressed up against a substrate surface using a method such as rolling or autoclaving, optionally in vacuo, to bring about bubble-free adhesion. The other protective layer is then stripped away, thereby exposing the other surface of the adhesive layer. The particles that will comprise the final layer are then applied to the exposed adhesive surface by means of dusting. This is followed by the removal of any weakly adhering particles from the final particle layer. Finally, the dry adhesive layer is itself removed by means of a heat treatment, thereby leaving a uniform layer of particles adhering to the substrate surface.

DESCRIPTION OF THE PREFERRED EMBODIMENTS

In the present invention, a dry adhesive is used for capturing and holding particles, particularly phosphor particles, against a substrate surface, such as the inside of a flat panel display or a CRT. The method uses a double-sided adhesive tape in order to accomplish this.

Figure 1:
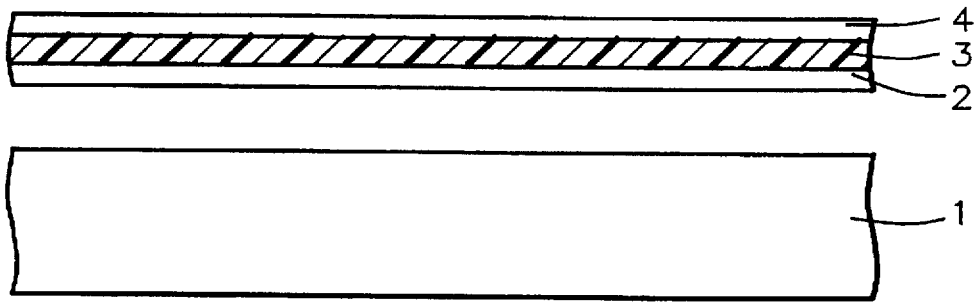
FIG. 1 illustrates a three layer laminated tape suspended above the surface of a substrate.

Referring now to FIG. 1, we show there, in schematic cross-section, a substrate 1 with a double-sided adhesive tape suspended immediately above it. Said tape is a laminate of three layers. The center layer 3 comprises the dry adhesive, typically a material such as acrylic. Layer 3 has a thickness between about 1 and 3 mils and may or may not be light sensitive (without affecting operation of the invention).

Layer 2, comprising polyethylene, and having a thickness between about 2 and 5 mils, is attached to the underside of layer 3. It adheres to layer 3 well enough to protect against damage to layer 3 during handling of the tape but lightly enough so that it can be stripped away from the underside of layer 3 whenever so desired.

Layer 4, comprising polyester, and having a thickness between about 2 and 5 mils, is attached to the topside of layer 3. It also adheres to layer 3 well enough to protect against damage to layer 3 during handling of the tape while still being capable of being stripped away from the topside of layer 3 whenever so desired.

Figure 2:
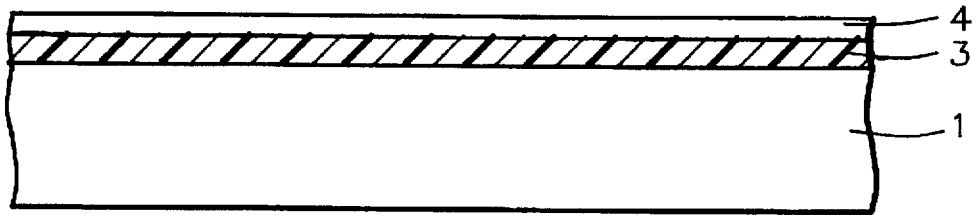
FIGS. 2 and 3 illustrate the application of the tape to the substrate, so that the latter is now covered with a layer of dry adhesive.

The first step in the utilization of the laminated tape is to strip away protective layer 2. This exposes the underside of layer 3 which is then pressed against the top surface of substrate 1 using a heated roller at a temperature of about 110° C. An important advantage of this method of applying an adhesive to a surface is that it is relatively easy to make sure that no bubbles, voids, etc. become trapped in the interface between substrate and adhesive. Standard methods for achieving this such as rolling, autoclaving, vacuuming, etc. are readily available. The appearance of the structure at this stage in the process is illustrated in FIG. 2.

Figure 3:
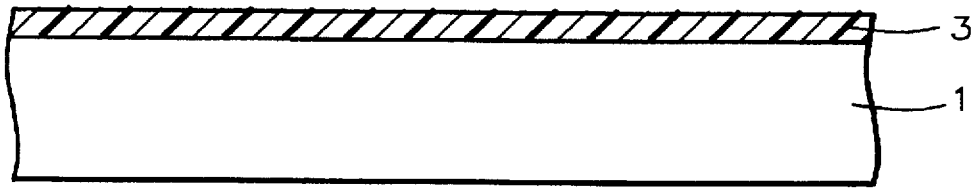

With adhesive layer 3 in good contact with the surface of substrate 1, the upper protective layer 4 is now readily stripped away, thereby exposing the upper surface of layer 3 and giving the structure the appearance illustrated in FIG. 3.

Figure 4:
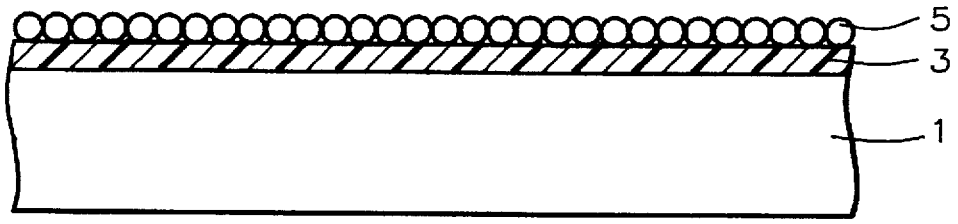
FIGS. 4 and 5 illustrate successive steps in the application of particles to the dry adhesive followed by its removal.

Referring now to FIG. 4, particles 5, for example phosphor particles comprising P22B (ZnS:Ag), P22G (ZnS:CdS:Ag), P22R ($Y_2O_2S$:Eu), or P45 ($Y_2O_2$:Tb) and having a size range between about 2 and 5 microns, out of which a layer is to be formed, are now applied to the exposed surface of layer 3. Our preferred method for achieving this has been dusting, by means of a spray of dry particles directed at the surface 3 from a moveable nozzle, but any method for applying the particles may be used without departing from the spirit of the present invention.

The method of the present invention makes possible the formation of a phosphorescent screen comprising only a single layer of particles, without the presence of dark spots.

However, at the time of their application to layer 3, there is, inevitably, a small excess of particles. These excess particles are weakly adherent to particles that are strongly adherent to the dry adhesive, and need to be removed. This is readily achieved by directing a fluid, such as Water or air, at the surface and blowing the weakly adhering particles away. Optionally, smaller particles of the same material may now be sprayed onto the screen so as to fill any voids left by the previously removed weakly adhering particles.

Figure 5:
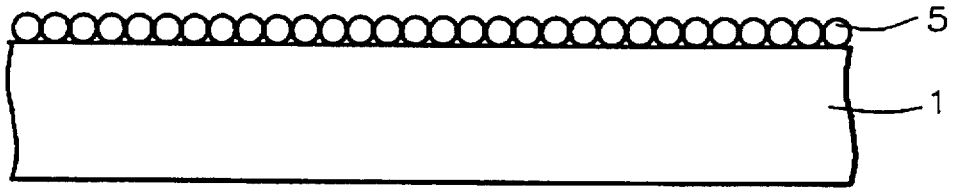

To complete the layer formation process, adhesive layer 3 must now be removed. This is accomplished by heating in an air or oxygen atmosphere for between about 120 and 150 minutes at a temperature between about 400° and 450° C. This heat treatment results in the decomposition of layer 3 into volatile reaction products and allows particle layer 5 to come into direct contact with substrate 1 to which it adheres because of Van der Waals adsorption, giving it the appearance illustrated in FIG. 5.

We note that the small particle size, whose use the present invention facilitates, leads to a CRT phosphor screen that has an optical resolution between about 50 and 100 lines/mm. It is anticipated that the method of the present invention will allow the formation of such screens with diameters up to about 40 inches.

In the foregoing description of a preferred embodiment of the present invention we have made reference to only one type of phosphor particle and an adhesive that is not necessarily light sensitive. This would imply that the end product of the process is a monochrome screen. It should be understood that one skilled in the art would be able to modify our process, as described above, so as to use a light sensitive dry adhesive more than once, in conjunction with several phosphors, each of which emits in a different wavelength range.

It is also possible to convert a white light emitting screen, such as might be produced through application of our process, into a color screen by one of several methods. For example a rotating wheel comprising three sectors, each being a primary color filter, could be placed in front of the white screen and then rotated during operation. Successive images, each representing a primary color would then be displayed on the white screen in synchrony with the rotating wheel. As an alternative, the color wheel could be replaced by a color Liquid Crystal Display of a greatly simplified design that behaved as a series of successive color filters operating in synchrony with the CRT.

While the invention has been particularly shown and described with reference to the above preferred embodiment, it will be understood by those skilled in the art that various changes in form and details may be made without departing from the spirit and scope of the invention.

What is claimed is:

1. A method for forming a uniform layer of particles on a substrate surface comprising:

providing a double-sided adhesive tape comprising a laminate of a dry adhesive with two opposing sides, having on a first opposing side a first protective, strippable layer and, on a second opposing side, a second protective, strippable layer;

stripping away said first protective layer, thereby exposing a first surface of said dry adhesive;

pressing said first surface against said substrate surface so as to bring about bubble-free adhesion between said first surface and said substrate surface;

stripping away the second protective layer, thereby exposing a second surface of said dry adhesive;

applying a first quantity of particles to said second surface, said first quantity of particles having a first particle size range, thereby causing the particles to stick to said second surface forming a first particle layer;

removing, from said second surface, particles that adhere only to other particles;

then applying a second quantity of particles, said second quantity of particles having a second particle size range wherein said second particle size range is less than said first particle size range, to said second surface, thereby filling possible voids in said first particle layer;

once more removing, from said second surface, particles that adhere only to other particles; and decomposing said dry adhesive layer into volatile products by means of a heat treatment, thereby removing the dry adhesive layer and leaving a uniform layer of the particles adhering to said substrate surface.

2. The method of claim 1 wherein said first protective, strippable layer comprises polyethylene.

3. The method of claim 1 wherein the thickness of said first protective, strippable layer is between about 2 and about 5 mils.

4. The method of claim 1 wherein said dry adhesive comprises acrylic.

5. The method of claim 1 wherein the thickness of said dry adhesive is between about 1 and about 3 mils.

6. The method of claim 1 wherein said second protective, strippable layer comprises polyester.

7. The method of claim 1 wherein the thickness of said second protective, strippable layer is between about 2 and about 5 mils.

8. The method of claim 1 wherein the step of pressing said first surface against said substrate surface further comprises rolling or autoclaving.

9. The method of claim 1 wherein the step of applying the particles to said substrate surface further comprises dusting through a spray nozzle.

10. The method of claim 1 wherein the step of removing particles that adhere only to other particles from said second surface further comprises blowing a fluid past all the particles.

11. The method of claim 1 wherein said heat treatment comprises heating at a temperature between about 400° and about 450° C. for between about 120 and about 150 minutes in an atmosphere of air or oxygen.

* * * * *